US007973258B2

(12) United States Patent
Yan et al.

(10) Patent No.: US 7,973,258 B2
(45) Date of Patent: Jul. 5, 2011

(54) HIGH-TENSION ELECTROSTATIC SEPARATOR LIFTING ELECTRODE

(75) Inventors: Eric S. Yan, Erie, PA (US); Michael Mankosa, Erie, PA (US); Jaisen Kohmuench, Erie, PA (US)

(73) Assignee: Eriez Manufacturing Co., Erie, PA (US)

( * ) Notice: Subject to any disclaimer, the term of this patent is extended or adjusted under 35 U.S.C. 154(b) by 141 days.

(21) Appl. No.: 12/362,534

(22) Filed: Jan. 30, 2009

(65) Prior Publication Data

US 2009/0194464 A1 Aug. 6, 2009

(51) Int. Cl.
*B03C 7/00* (2006.01)

(52) U.S. Cl. ... 209/129; 209/12.1; 209/12.2; 209/127.1; 209/128; 209/130

(58) Field of Classification Search ..... 209/12.1, 209/12.2, 127.1, 128, 129, 130
See application file for complete search history.

(56) References Cited

U.S. PATENT DOCUMENTS

| | | | | |
|---|---|---|---|---|
| 1,178,430 | A | 4/1916 | Wentworth | |
| 2,071,460 | A * | 2/1937 | Grave | 209/128 |
| 3,322,275 | A | 5/1967 | Breakiron et al. | |
| 4,265,789 | A | 5/1981 | Christopherson et al. | |
| 4,341,744 | A * | 7/1982 | Brison et al. | 423/206.2 |
| 5,829,598 | A * | 11/1998 | Whitlock | 209/128 |
| 6,291,568 | B1 * | 9/2001 | Lussey | 524/413 |
| 6,376,594 | B1 | 4/2002 | Sasagawa et al. | |
| 6,390,302 | B1 | 5/2002 | Abrarov et al. | |
| 6,467,628 | B1 | 10/2002 | Maehata et al. | |
| 6,652,715 | B2 * | 11/2003 | McLaine | 204/164 |
| 6,720,514 | B1 | 4/2004 | Inoue et al. | |
| 6,723,938 | B1 | 4/2004 | Gates | |
| 6,797,908 | B2 | 9/2004 | Yan et al. | |
| 6,951,992 | B2 | 10/2005 | Yan et al. | |
| 7,041,925 | B2 | 5/2006 | Gates | |
| 7,045,734 | B2 | 5/2006 | Yan et al. | |
| 2005/0092656 | A1 * | 5/2005 | Yan et al. | 209/12.2 |
| 2005/0121369 | A1 * | 6/2005 | Yan et al. | 209/127.1 |
| 2008/0297980 | A1 * | 12/2008 | Bourcier et al. | 361/502 |
| 2009/0001009 | A1 * | 1/2009 | Linder et al. | 210/243 |
| 2009/0194464 | A1 * | 8/2009 | Yan et al. | 209/129 |

OTHER PUBLICATIONS

International Preliminary Examination Report, completed Aug. 27, 2010 by Stefanos Karmis, Authorized Officer; 8 pages.

* cited by examiner

*Primary Examiner* — Terrell H Matthews
(74) *Attorney, Agent, or Firm* — Jonathan M. D'Silva; MacDonald, Illig, Jones & Britton LLP

(57) ABSTRACT

A lifting electrode for a high-tension electrostatic separator. The high tension electrostatic separator having a rotating drum that is connected to ground and an ionizing electrode that generates a corona discharge of charged ions. The lifting electrode comprising a composite of a non-conductive polymer impregnated with conductive particles.

7 Claims, 2 Drawing Sheets

HIGH-TENSION ELECTROSTATIC SEPARATOR LIFTING ELECTRODE

BACKGROUND

High-tension electrostatic separators are commonly used to separate particles in a matter stream based on the varying conductivity of the constituent components. In the processing industry more conductive particles often need to be sorted from relatively less conductive particles. The difference in conductivity provides a means of separating such materials using a high-tension electrostatic separator. High-tension electrostatic separators use high voltage (about 30 kV) ionizing electrodes that generate an electrical discharge (commonly referred to as corona) to ionize the air. This ionization bombards the matter stream with ions and electrons as they pass over a grounded rotating drum. This charges the matter stream according to the polarity of the ionizing electrode and pins the mixture of the matter stream to the rotating drum. The more conductive particles in the matter stream lose their charge faster than less conductive particles and are thrown away from the rotating drum (i.e., by centrifugal force). A lifting electrode downstream of the ionizing electrode is used to further improve the efficiency of the separation by creating an electric field that attracts the more conductive particles by inducing a new charge on their surface and causing them to deviate from their natural falling trajectory as they are thrown from the rotating drum.

Some prior art lifting electrodes are prone to arcing—i.e. visible electrical discharges are formed from the lifting electrode to the rotating drum. Arcing disrupts the electrical field normally generated by the lifting electrode thereby greatly reducing the effectiveness of the separation process. To address this deficiency, other prior art lifting electrodes are encased in glass which is fragile in industrial applications and prone to cracking or breaking from impacts of particles from the matter stream hitting the encased electrode. Other prior art lifting electrodes require significantly more power to be used to generate comparable electrical fields.

SUMMARY

A lifting electrode for a high-tension electrostatic separator is presented for use with high tension electrostatic separators having a rotating drum that is connected to ground and an ionizing electrode that generates a corona discharge of charged ions. The lifting electrode is formed from a composite of a non-conductive polymer impregnated with conductive particles.

In one embodiment, the non-conductive polymer of the lifting electrode is Ultra High Molecular Weight Polyethylene. In another embodiment, the conductive particles in the lifting electrode are graphite.

The lifting electrode can be connected to the high-tension electrostatic separator's high voltage power source through the same circuit as the ionizing electrode or through a different circuit than the ionizing electrode. The lifting electrode in certain embodiments can also be charged by induction due to its proximity to the ionizing electrode.

Those skilled in the art will realize that this invention is capable of embodiments that are different from those shown and that details of the structure of the lifting electrode can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention and its many advantages, reference will be made to the following detailed description taken in conjunction with the accompanying drawings.

DETAILED DESCRIPTION

Figure 1:
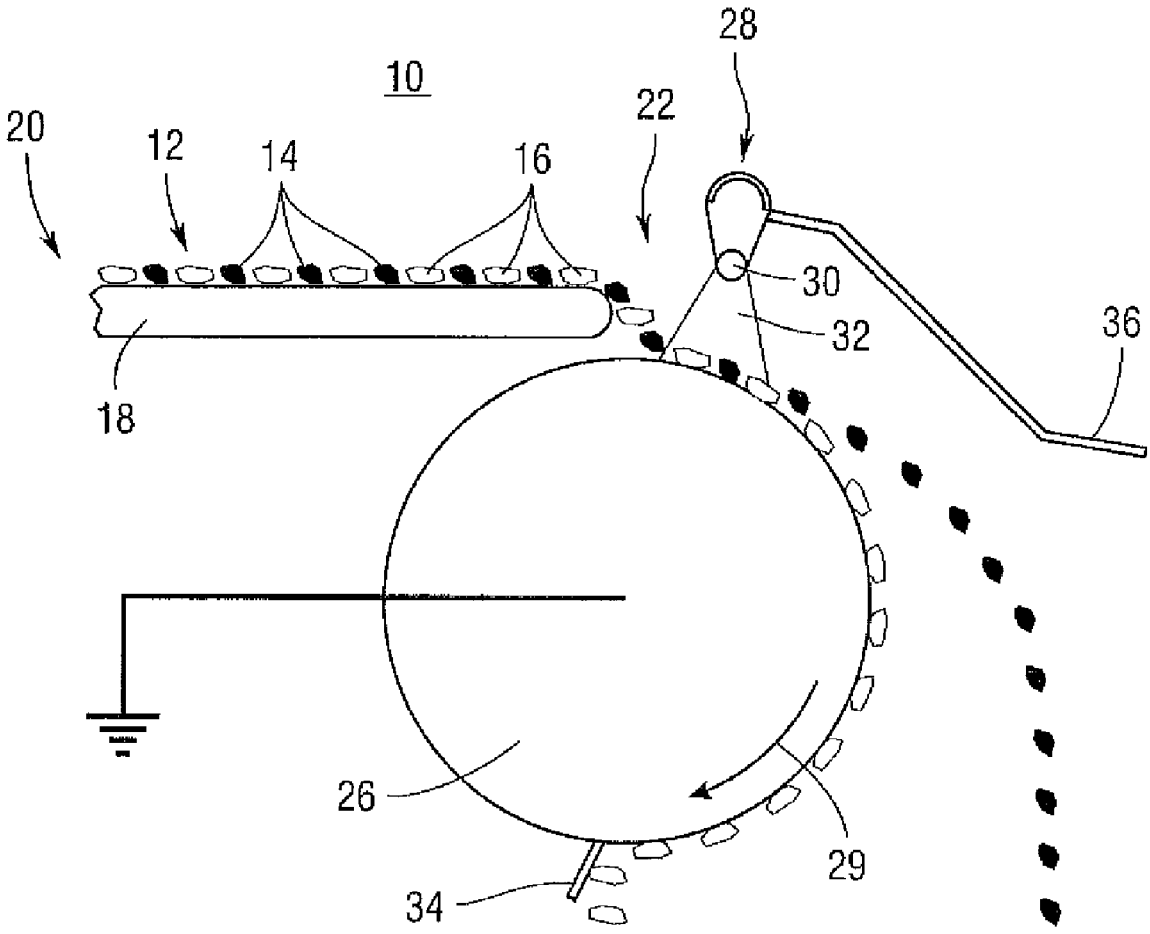
FIG. 1 is a representation of the principle of high-tension electrostatic separation.

Referring to the drawings, some of the reference numerals are used to designate the same or corresponding parts through several of the embodiments and figures shown and described. Corresponding parts are denoted in specific embodiments with the addition of lowercase letters. Variations of corresponding parts in form or function that are depicted in the figures are described. It will be understood that generally variations in the embodiments can be interchanged without deviating from the invention.

The schematic shown in FIG. 1 shows the basic principle of high-tension electrostatic separators 10. A matter stream 12 comprising more conductive particles 14 (the solid colored particles in the figure) and less conductive particles 16 (the clear particles in the figure) is conveyed by a feed system 18. The feed system 18 comprises a first end 20, from which the matter stream 12 enters the high-tension electrostatic separator 10, and a second end 22, to which the matter stream 12 is transported towards. The feed system 18 deposits the matter stream 12 onto a rotating drum 26 that is located at about the second end 22. The feed system 18 shown in the figures are by way of example only and may be of any appropriate type, including a roll-feeder, vibratory feeder, gravity feeder, chute, or any other means of transporting the matter stream 12 onto the rotating drum 26. The rotating drum 26 is electrically connected to ground and rotates to move the matter stream 12 to pass under an ionizing electrode 30. In the example shown in FIG. 1, the direction of rotation relative to the matter stream 12 is indicated by the arrow 29.

The size and rotational speed of the rotating drum 26 varies depending on the particular system, but typically a rotating drum 26 having a 10-inch diameter is spun at rates ranging from about 200 to 350 rpm. Larger diameter rotating drums 26 spin at lower rates, for example a 12-inch rotating drum 26 is rotated at around 150 to 250 rpm. The rotating drum 26 is at least as wide as, or wider than, the feed system 18 to capture the entire matter stream 12 that is delivered to it. Typical feed systems 18 are about 60-inches wide and typically have a load rate of about 2 to 3 tons of matter per hour.

An electrode assembly 28 is located downstream of the feed system 18 and above the rotating drum 26, generally about two inches away from the rotating drum 26. The electrode assembly 28 provides housing for an ionizing electrode 30. The ionizing electrode 30 is typically a length of fine wire that is at least as long as the width of the rotating drum 26. The ionizing electrode 30 is connected to a high voltage power supply, usually about 30 kV. When the voltage is applied to the electrode assembly 28, the ionizing electrode 30 generates a very intense high voltage electrical corona discharge of charged ions that ionizes the surrounding air from the ionizing electrode 30 to the rotating drum 26. This discharge is directed towards the path of the matter stream 12 creating a pinning zone 32. As the matter stream 12 passes though the pinning zone 32, the surface of the particles in the matter stream 12 are electrically charged due to the ion bombardment from the ionizing electrode 30 which causes them to be pinned to the surface of the rotating drum 26. As the rotating drum 26 rotates, the more conductive particles 14 lose their charge to the earth-grounded rotating drum 26 more rapidly than the less conductive particles 16 and are thrown off the rotating drum in a trajectory caused by the centrifugal force induced on the particles by the rotation of the rotating drum 26. The less conductive particles 16 lose their charge less rapidly and remain pinned to the rotating drum 26 for a longer time and fall off at a different location than the more conductive particles 14 or are mechanically removed from the rotating drum 26, for example with a brush 34 as shown in FIG. 1.

The ionizing electrode 30 is adjacent and parallel to a large lifting electrode 36 that it is electrically, and optionally mechanically, in contact with the electrode assembly 28. The lifting electrode 36 is located downstream of the ionizing electrode 30. In one embodiment of the invention, the lifting electrode 36 is formed into a profile that is a continuous conducting surface that generates an evenly distributed electric field. In contrast to the ionizing electrode 30, the electric field generated by the lifting electrode 36 is non-discharging and will attract the more conductive particles 14 as they lose the charge acquired from passing through the pinning zone 32 and fall away from the rotating drum 26. The electrical field generated by the lifting electrode 36 induces a surface charge on the more conductive particles 14 and causes them to deviate from their natural falling trajectory. The lifting electrode 36 can be shaped into a profile that generally conforms to a desired trajectory for the more conductive particles 14. This serves to increase the effectiveness and efficiency of the separation.

Lifting electrodes in the prior art generally comprise conductive metals in various configurations. The large amount of fine matter that passes from the feed system 18 and over the rotating drum 26 generates dust in the gap between the rotating drum 26 and the high voltage ionizing electrode 30 and lifting electrode 36. Imperfections in the prior art lifting electrodes create visible arcs of electricity in the narrow space between the high voltage electrodes and the grounded rotating drum. These arcs disrupt ability of the electrode assembly to ionize and separate the particles in the matter stream. It is thought that such arcing is caused when electrons "jump" from the imperfections in such prior art lifting electrodes to the dust from the matter stream and into the grounded rotating drum. This phenomenon is generally referred to as bridging. This arcing is a serious disruption of the separation process as it interrupts the ability of the ionizing electrode to create a pinning zone and/or in the ability of the lifting electrode to generate a suitable lifting electric field. To address such arcing issues, various means for protecting prior art lifting electrodes were introduced, including encasing the lifting electrode in glass (which, while reducing the incidences of arcing, makes the lifting electrode prone to damage and breakage in industrial applications), or coating the electrode in a thin layer of protective Teflon (however, if the layer is too thin the arcing problem is actually more intense and if the layer of Teflon is too thick, then a higher voltage is required to generate an equivalent electrical field).

To reduce, if not substantially eliminate the incidences of arcing, obtain suitable continuous conducting profiles, and improve the efficiency and operability of high tension electrostatic separators 10, the lifting electrodes 36 disclosed herein are made from a composite material comprising a non-conductive polymer impregnated with conductive particles. The characteristics of this electrode material allows for the manufacture of numerous profiles and configurations while generating an evenly distributed, non-arcing and non-disruptive electric field. The non-conductive polymer can be Ultra High Molecular Weight Polyethylene. The conductive particles can be graphite. TIVAR CleanStat, UHMW-Polyethylene manufactured by Menasha Corporation has been found to be an effective material to use for the lifting electrode 36. However it is to be understood that other materials, non-conductive polymers, and/or conductive particles would work as well.

Lifting electrodes 36 formed with such materials have been found to have little or no arcing between the lifting electrode 36 and the rotating drum 26, even at close proximity. These materials are also corrosion resistant, lightweight, thermally stable, and non-perishable with a low coefficient of friction and can be easily formed into various geometric profiles.

The lifting electrode 36 can be formed into any appropriate profile. Generally, the lifting electrode 36 should be formed to be at least as wide as the rotating drum 26 and should be shaped such that the resulting electric field influences the falling trajectory of the more conductive particles 14 as they are thrown from the rotating drum 26 and are attracted by the lifting electrode 36, for example as with the profiles shown in FIGS. 1 through 3.

Figure 2:
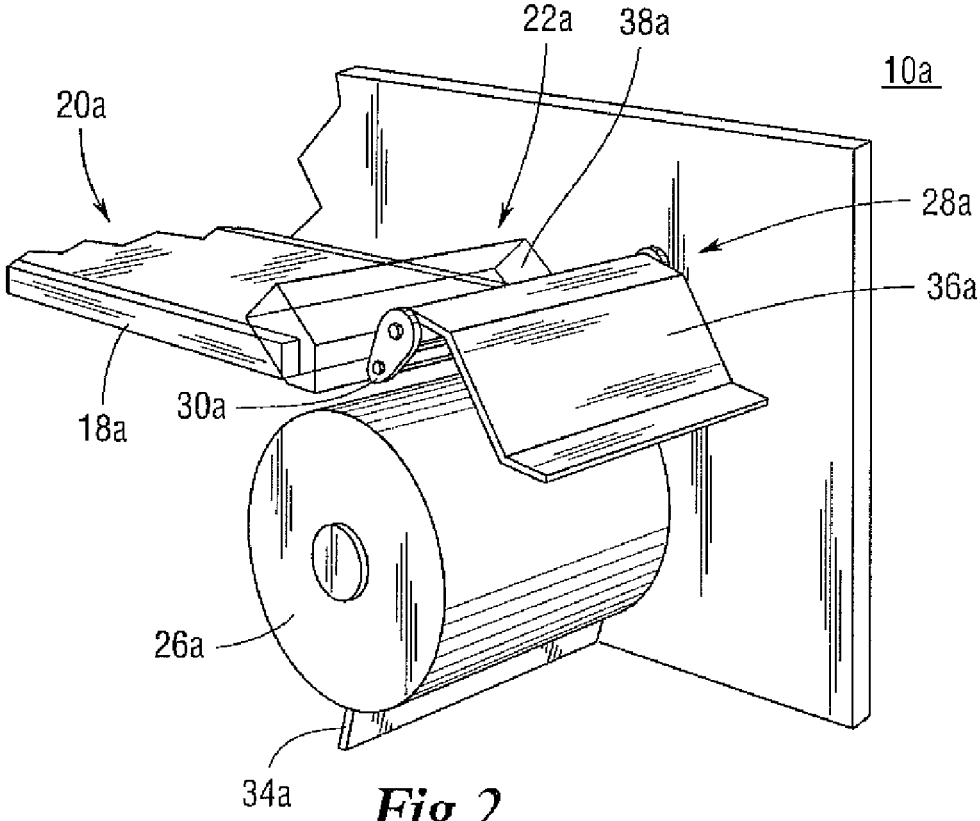
FIG. 2 is a perspective view of a high-tension electrostatic separator.

In the perspective view of the embodiment of high-tension electrostatic separator 10*a* shown in FIG. 2, a shield 38*a* is incorporated at the second end 22*a* of the feed system 18*a* to help protect the electrode assembly 28*a* from stray particles from the mixture of particulate materials in the matter stream 12*a*.

Figure 3:
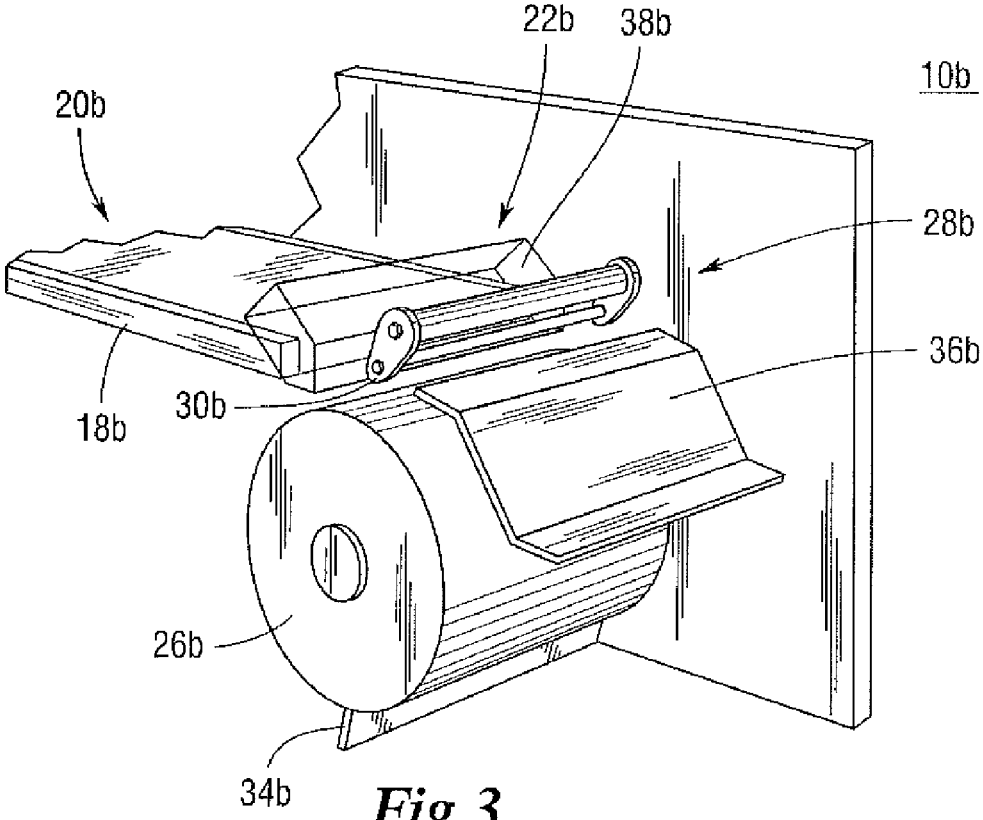
FIG. 3 is a perspective view of a high-tension electrostatic separator in which the lifting electrode is not attached to the ionizing electrode.

As shown in FIG. 3, the lifting electrode 36*b* may alternatively be spaced apart from the ionizing electrode 30*b* if desired to obtain a more favorable electric field profile. In this case, the lifting electrode 36*b* can be charged by induction in which it is energized, not by a direct connection to a power source, but by being in proximity to the ionizing electrode 30*b*. The induced charge in the lifting electrode 36*b* has a lower potential than the charge supplied to the ionizing electrode 30*b*. This allows the ionizing electrode 30*b* and the lifting electrode 36*b* to operate at two different potential levels. The greater the distance between the lifting electrode 36*b* and the ionizing electrode 30*b*, the lower is the induced charge in the lifting electrode 36*b*. Depending on the desired intensity, the distance between the ionizing electrode 30*b* and the lifting electrode 36*b* can be 1/16" to 1/4". This allows greater flexibility when treating material that simultaneously requires a high pinning force with a lower lifting force which is generally required for applications with larger particle sizes in the material feed 12*b* where a more focused pinning force is required because the lifting force is not as effective in the separation process.

The lifting electrode 36*b* and the ionizing electrode 30*b* can also be connected to different power circuits such that each electrode operates as a different potential level. This will allow for applications as discussed above that require a higher pinning force and a lower lifting force. In applications in which the material feed comprises fine particles, the lifting force is significantly more important than the pinning force and a higher lifting force is required. This is also the case with plastics recycling and chopped-wire processing. Such applications are well suited to such configurations of separate power supply for the lifting electrode 36*b* and the ionizing electrode 30*b*. In such cases, the lifting electrode 36*b* can be spaced at a greater distance away from the ionizing electrode 30*b* than if it were energized by induction.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A high-tension electrostatic separator for separating more conductive particles from less conductive particles based on their differing conductivity from a mixture of such particles in a matter stream, the high-tension electrostatic separator comprising:

a feed system for conveying the matter stream, said feed system comprising a first end on which the matter stream is deposited and a second end to which the matter stream is transported over said feed system, a rotating drum located at about said second end, said rotating drum is connected to ground, said feed system deposits the matter stream onto said rotating drum; said rotating drum rotates to move the matter stream that is deposited on it, an ionizing electrode located downstream of said feed system and above said rotating drum, said ionizing electrode connected to a high voltage power source to generate a corona discharge of charged ions from said ionizing electrode to said rotating drum in the path of the matter stream; said corona discharge electrically charges the surface of the particles in the matter stream pinning them said rotating drum;

a lifting electrode located downstream of said ionizing electrode, said lifting electrode made from a material comprising a non-conductive polymer impregnated with conductive particles, said lifting electrode creating an electrical field that induces the more conductive particles in the matter stream to deviate from their natural trajectory as they fall off the rotating drum.

2. The high-tension electrostatic separator according to claim 1 in which said non-conductive polymer is Ultra High Molecular Weight Polyethylene.

3. The high-tension electrostatic separator according to claim 1 in which said conductive particles are graphite.

4. The high-tension electrostatic separator according to claim 1 in which said feed system comprises one of a conveyor belt, a gravity chute, or a vibrating chute.

5. The high-tension electrostatic separator according to claim 1 in which said lifting electrode is connected to the high voltage power source through the same circuit as said ionizing electrode.

6. The high-tension electrostatic separator according to claim 1 in which said lifting electrode is connected to the high voltage power source through a different circuit than said ionizing electrode.

7. The high-tension electrostatic separator according to claim 1 in which said lifting electrode is charged by induction due to its proximity to said ionizing electrode.

* * * * *